United States Patent [19]

Morris et al.

[11] 4,359,665

[45] Nov. 16, 1982

[54] FILAMENT SUPPORT FOR TUBULAR LAMP

[75] Inventors: Merle E. Morris, Lexington; Steven L. Meade, Winchester, both of Ky.

[73] Assignee: GTE Products Corporation, Stamford, Conn.

[21] Appl. No.: 165,308

[22] Filed: Jul. 2, 1980

[51] Int. Cl.[3] ..... H01J 1/96; H01J 19/50; H01K 1/18

[52] U.S. Cl. ..... 313/274; 313/278; 313/279

[58] Field of Search ..... 313/274, 279, 271, 278

[56] References Cited

U.S. PATENT DOCUMENTS

| | | | |
|---|---|---|---|
| 3,173,051 | 3/1965 | Berlinghof et al. | 313/274 |
| 3,335,312 | 8/1967 | Cardwell, Jr. | 313/274 X |
| 3,634,722 | 1/1972 | Palmer et al. | 313/274 |
| 3,678,319 | 7/1972 | Notelteirs et al. | 313/279 |
| 3,736,455 | 5/1973 | Notelteirs et al. | 313/279 |
| 3,780,333 | 12/1973 | Flynn | 313/279 |
| 4,208,606 | 6/1980 | Newton | 313/274 |

*Primary Examiner*—Saxfield Chatmon, Jr.
*Attorney, Agent, or Firm*—Edward J. Coleman

[57] ABSTRACT

A wire support for the coiled-coil filament of a tubular double-ended incandescent lamp in which the support is formed of a single wire which extends longitudinally along a portion of the inner wall of the lamp envelope, with each end of the support wire terminating in a loop of a size to be circumferentially engageable with the inner wall of the envelope, and a midportion of the support wire extending laterally in closed loop form to firmly embrace a localized point on a turn of the filament so that the turn extends through that midportion loop and is supported therefrom.

7 Claims, 5 Drawing Figures

FILAMENT SUPPORT FOR TUBULAR LAMP

BACKGROUND OF THE INVENTION

This invention relates generally to electric incandescent lamps, and more particularly to tubular lamps having an axially extending coiled filament. Still more particularly, the invention relates to filament supports for tungsten-halogen lamps having tubular envelopes of the double ended type with coiled coil filaments, i.e., filaments formed by winding the filament wire to form a helical primary coil which is again helically coiled to form the secondary coil of the coiled coil filament.

A persistent problem in the manufacture of such lamps using a coiled coil filament is that of providing support for the center of the filament to prevent damage to the filament due to vibration and/or sagging of the center of the hot filament. Accordingly, in tubular lamps of the double ended type having an axially extending filament connected at its ends to lead-in conductors sealed through opposite ends of the envelope, it has been the practice to provide auxillary support members at one or more locations on the filament, intermediate its ends, to support the filament from the envelope walls and maintain it generally at the axis of the envelope. For a filament in the form of a simple helical coil, a widely used form of support comprises a wire member having one end coiled around the exterior of several turns of the helical filament coil and extending therefrom, usually in the general form of a spiral, to be circumferentially engageable with the inner wall of the envelope. However, such a support is not suitable for coiled coil filaments, particularly filaments of high wattage and therefore relatively large size. Previous attempts to provide a suitable support for coiled coil filament lamps have suffered from various disadvantages such as failure to firmly support the filament in the axis of the envelope, difficulty in making the support and assembling it with the other lamp components, and electrical short circuiting of portions of the filaments in varying degrees or requiring additions to the length of the filament thereby nullifying, to some degree, the desireable compactness of a coiled coil filament.

For example, U.S. Pat. Nos. 3,194,999; 3,195,000 and 3,678,319 illustrate various filament support arrangements in which a portion of the support member is fastened or secured in some manner to the center of the filament, and another end of the support is wedged into the tipped off area of the exhaust tubulation of the envelope. Such support methods, however, require considerably costly techniques to assure that the support is wedged ridgely into the "tip" by molten quartz while not extending through the quartz tip, which could cause the envelope to leak.

U.S. Pat. Nos. 3,270,238; 3,335,312; 3,736,455 and 3,784,865 illustrate filament support arrangements wherein one portion of the support member is fastened to or looped around the center or another intermediate portion of the filament, and the end or ends of the support are wedged into the press seal area of the envelope. Such methods require costly techniques at assembly and/or at press sealing to assure the correct turns per inch for each half of the coiled coil filament. Further such constructions also add considerable cost to the lamp.

U.S. Pat. No. 3,195,000 describes a filament support arrangement in which the coiled coil filament is interrupted or separated at a point intermediate its ends to define separate sections or segments, and the adjacent interrupted ends are joined by a support member comprising a wire portion which is formed to conform to at least a portion of a turn of the secondary coiling of the filament. The support further includes an enlarged helical portion which engages the inner wall of the lamp envelope. Clearly, this approach introduces complexities into both the assembly and structure of the lamp, and reliance upon a single helical wall support for maintaining proper positioning of the filament does not offer the enhanced degree of reliability provided by the structure to be defined hereinafter.

U.S. Pat. No. 3,521,112 describes a support member which loosely encircles the filament and also engages the envelope wall. The primary embodiments illustrate one end of the support member secured in the pinch seal of the lamp. In another embodiment described, however, a helical wire support about the filament, and positioned centrally within the envelope, has legs which extend in both directions close to the pinch seals but are not anchored therein. Although comparatively simple, such a support arrangement appears to permit a greater degree of tolerance in support and/or filament coil movement than is permissable in many applications.

Hence, while the aforementioned prior art supports hold the filament in the desired center location of the envelope and tend to prevent damage to the filament due to vibration, they are comparatively complicated, more costly, or lack the degree of reliability against filament failure that is desired in a number of applications.

SUMMARY OF THE INVENTION

Accordingly, it is an object of the present invention to provide a support structure for the filament of double ended lamps of the type described, especially when provided with helically coiled coil filaments, which is of simple construction, permits ease of assembly, and will effectively support the filament uner conditions of vibration and/or sagging of the center of the hot filament.

These and other objects, advantages and features are attained, in accordance with the invention, by a wire support member which extends longitudinally along a portion of the inner wall of the lamp envelope, with each end of the support wire terminating in a loop of a size to be circumferentially engageable with the inner wall of the envelope around at least half of its circumference, and with a midportion of the support wire extending laterally in substantially closed loop form enclosing and embracing a localized point on a turn of the coiled filament so that the turn extends through the midportion loop and is supported therefrom. The wire support is comparatively easy to manufacture and assemble into the lamp, and it provides a firm support for the filament without requiring portions of the support wire to be embedded into the "tip" or end seals of the lamp. Further, separate coil segments are not required.

BRIEF DESCRIPTION OF THE DRAWINGS

This invention will be more fully described hereinafter in conjunction with the accompanying drawings in which.

DESCRIPTION OF PREFERRED EMBODIMENT

Figure 1:
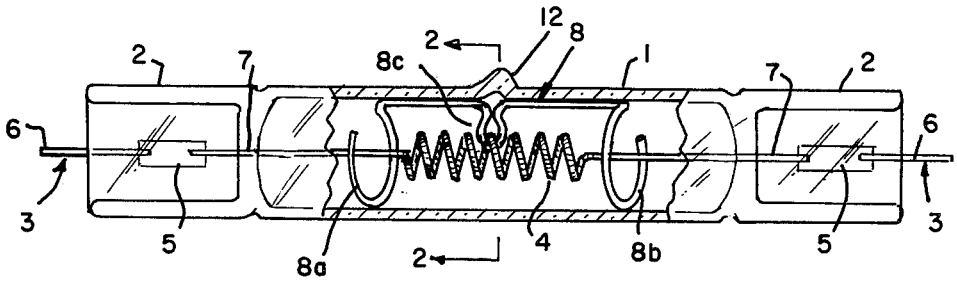
FIG. 1 is a side elevation of a lamp having a filament support in accordance with the invention.
Figure 2:
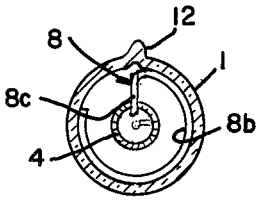
FIG. 2 is a section of the lamp taken along the line 2—2 in FIG. 1.

Referring to FIGS. 1 and 2, the lamp illustrated therein comprises a tubular envelope 1 of vitreous material having compressed pinch seals 2 at its opposite ends through which extend lead-in conductors 3 having their inner ends connected to respective ends of a helically coiled coil filament 4 which extends longitudinally through the interior of the envelope. The lamp may be of the so-called tungsten-halogen type, wherein the filament 4 is of tungsten wire and the envelope 1 contains a halogen additive, such as iodine or bromine, which functions as a regenerative getter to return to the filament 4 tungsten which is vaporized therefrom during operation of the lamp. The envelope preferably also contains a filling of inert gas such as nitrogen, argon, krypton or xenon at substantial pressure, preferably exceeding atmospheric. Since the envelope of such a lamp during operation attains elevated temperature exceeding 250° C., it is preferably made of a light transmitting material of relatively high melting point such as fused silica, or quartz, or the material known as Vycor and comprising 96% silica. High melting point glasses such as borosilicate or aluminosilicate may also be suitable. The envelope exhaust tip is shown as 12. Each of the lead-in conductors 3 includes an intermediate foil portion 5 preferably of molybdenum, which is hermetically sealed in the pinch seal 2, an outer portion 6, preferably of molybdenum, and an inner portion 7, preferably of tungsten and which is connected to the adjacent end of the filament 4 in any suitable manner.

In accordance with the present invention, the filament 5 is supported along the longitudinal axis of the envelope by a single support member 8 in the form of a wire which extends longitudinally along the inner wall of the envelope 1 and with each end of the support wire 8 terminating in a respective loop section, 8*a* or 8*b*, which extends around at least half of the circumference of the inner envelope wall to be in engagement therewith. A midportion of the wire support 8 extends laterally in a closed loop form 8*c* which encloses and firmly embraces a localized point on a single primary turn of the coiled coil filament 4 so that the turn extends through the loop 8*c* and is supported therefrom.

The closed support loop 8*c* constrains the filament 4 in all directions; the support member 8 is firmly held and is insensitive to unavoidable variations in the diameter of commercial tubing from which the envelope 1 is made.

Figure 3:
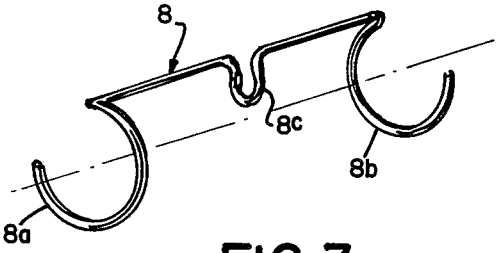
FIG. 3 is a perspective view of the support member in preliminary form before assembly with the filament.
Figure 4:
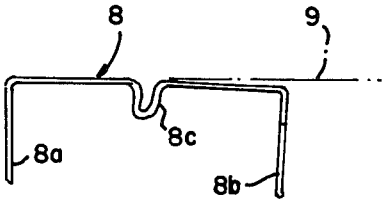
FIG. 4 is a side elevation of the support member of FIG. 3.
Figure 5:
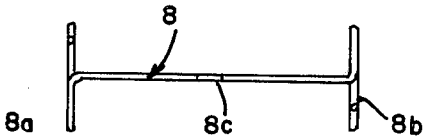
FIG. 5 is a top view of the support member of FIG. 3.

Assembly of the support 8 is facilitated by preliminarily forming it from a single length of wire, preferably tungsten, as shown in FIGS. 3–5, with the left-hand loop 8*a* being turned in one direction, and the right-hand end loop 8*b* turned in the opposite direction, as indicated, and by forming the loop 8*c* in an open U-shape. Further, the right-hand leg of the support wire 8 is at a slight angle to the left-hand leg, as indicated more clearly by its deviation from the broken line extension 9 of the left-hand leg thereof in FIG. 4. The support 8 is thereby easily threaded between successive secondary turns of the coiled-coil filament 4 to engage one of the primary turns within the loop 8*c*; the right-hand leg (FIG. 4) of the wire 8 is then bent up into alignment with the left-hand leg during assembly into the lamp to close the loop 8*c* upon the filament primary turn as shown in FIG. 1.

More particularly, the support wire 8 is designed so that insertion of the coil into the support is facilitated by slightly springing open the central loop 8*c* and, thereafter, upon release, a slight pressure is applied to the localized point of the primary turn of the filament 4 to hold the filament firmly in position. Upon insertion into envelope 1 of the filament 4 with a support 8 attached, a slight pressure is applied to the end loops 8*a* and 8*b* by the internal walls of the envelope to maintain a firm grip of the supporting central loop 8*c* onto the primary turns of the filament 4. The support 4 holds the filament firmly in the center of the envelope 1 to provide better operational characteristics while serving to more reliably and at lower cost accomplish a reduction in filament damage due to filament vibration or sagging of a hot filament.

In the preferred embodiment illustrated, the midportion loop 8*c* of the support wire encloses and embraces the coiled coil filament at a localized point which is substantially midway between the sealed ends of the envelope, and the end loops 8*a* and 8*b* of the support are symmetrically disposed on each side of the midportion loop 8*c* toward the respective ends of the envelope. As mentioned above, the end loops of the support wire are compressed for insertion into the envelope and thereby firmly engage the inner wall thereof.

Accordingly, although the invention has been described with respect to a specific embodiment, it will be appreciated that modifications and changes may be made by those skilled in the art without departing from the true spirit and scope of the invention. For example, the technique may be employed for other than center support, and the end loops in certain applications may be other than symmetrically disposed on each side of the midportion loop 8*c*. Also, where appropriate, other metals may be employed for the filament and support wire.

We claim:

1. In an electric incandescent lamp of the double-ended type including a tubular envelope sealed at each end thereof, a helically coiled filament extending longitudinally through the interior of said envelope, and lead-in conductors connected at respective ends of said filament and hermetically sealed in said respective end seals of said envelope and extending exteriorly thereof, the improvement comprising:

a filament support in the form of a wire including a midportion and a pair of opposing end portions, said filament support extending longitudinally along a portion of the inner wall of said envelope, each of said end portions of said support wire terminating in a loop which is circumferentially engageable with the inner wall of said envelope around at least one-half of the circumference thereof, said midportion of said support wire extending laterally in the form of a single, substantially closed loop enclosing and embracing a localized point on a turn of said coiled filament so that said turn extends through said midportion loop and is supported therefrom, each of said end loop portions of said support wire being compressed prior to insertion within said envelope such that when said end loop portions are positioned within said envelope, a slight pressure is applied thereto by said internal wall of said envelope, said end loop portions in turn assisting to maintain said single loop of said midportion in said substantially closed form to assure a firm grip by said single loop on said filament.

2. The improvement of claim 1 wherein said midportion loop of said support wire enclosing and embracing said coiled filament at a localized point thereon is substantially midway between the sealed ends of said envelope.

3. The improvement of claim 2 wherein said end loops of the support wire are symmetrically disposed on each side of said midportion loop toward respective ends of said envelope.

4. The improvement of claim 3 wherein said loop of said midportion firmly embraces said localized point on a turn of the coiled filament.

5. The improvement of claim 1 wherein said filament is a helically coiled coil, and said midportion loop of the support wire encloses and embraces a localized point on a primary turn of said coiled coil filament so that said primary coiled coil turn extends through said midportion loop and is supported therefrom.

6. The improvement of claim 5 wherein said coiled coil filament and said support wire are tungsten.

7. The improvement of claim 1 wherein said envelope is quartz and contains a fill of inert gas and halogen.

* * * * *